US006299001B1

(12) United States Patent
Frolov et al.

(10) Patent No.: US 6,299,001 B1
(45) Date of Patent: Oct. 9, 2001

(54) WALL ORGANIZER SYSTEM

(75) Inventors: Andrew E. Frolov, Glenview; John R. Guskey, Mt. Prospect, both of IL (US)

(73) Assignee: Midwest Air Technologies, Inc., Lincolnshire, IL (US)

( * ) Notice: Subject to any disclaimer, the term of this patent is extended or adjusted under 35 U.S.C. 154(b) by 0 days.

(21) Appl. No.: 09/391,952

(22) Filed: Sep. 8, 1999

(51) Int. Cl.[7] ..... A47F 5/08; A47F 5/01; A47G 29/02

(52) U.S. Cl. ..... 211/106; 211/181.1; 211/119; 248/220.21

(58) Field of Search ..... 211/106, 54.1, 211/57.1, 59.1, 133.2, 133.5, 181.1, 119, 103; 248/220.21, 220.22, 220.31, 220.41, 220.43, 227.2, 250

(56) References Cited

U.S. PATENT DOCUMENTS

| | | | | |
|---|---|---|---|---|
| D. 392,178 | * | 3/1998 | Hirano | D8/382 |
| 4,340,144 | * | 7/1982 | Cousins | 211/106 X |
| 4,450,961 | * | 5/1984 | Bies et al. | 211/69 X |
| 4,516,681 | * | 5/1985 | Jahel | 211/59.1 |
| 5,299,698 | * | 4/1994 | Gay | 211/181.1 |
| 5,461,550 | * | 10/1995 | Johnstone | 362/147 |
| 5,482,168 | * | 1/1996 | Welch et al. | 211/106 |
| 5,690,238 | * | 11/1997 | Schmehr | 211/106 |
| 6,050,426 | * | 4/2000 | Leurdijk | 211/57.1 X |
| 6,070,747 | * | 6/2000 | Shea | 211/87.01 |

OTHER PUBLICATIONS

Closetmaid® Closet Planning Guide for Shelf Track Installation of 5 pages, (date unknown) Mar., 1999 or earlier.
Le Garage Doit Vous ReVez brochure, Mottez, Armentieres, France (date unknown) Mar., 1999 or earlier of 3 pages.

* cited by examiner

*Primary Examiner*—Jerry Redman
*Assistant Examiner*—Erica B. Harris
(74) *Attorney, Agent, or Firm*—Greer, Burns & Crain, Ltd.

(57) ABSTRACT

A wall organizer system for storing items on a wall, includes at least one panel of wire mesh including a plurality of spaced, parallel, vertical rods joined to a plurality of spaced, parallel horizontal rods to define a plurality of quadrilateral mounting points, at least one wall bracket for mounting the at least one panel to the wall, at least one universal mounting plate configured for being secured in one of the mounting points and for accommodating at least one suspending member, and at least one suspending member configured for engagement on at least one of the at least one universal plate and directly to the panel.

18 Claims, 12 Drawing Sheets

FIG. 5
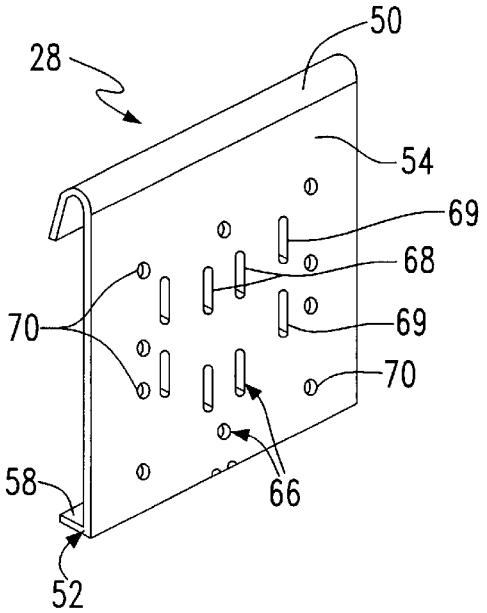
FIG. 6
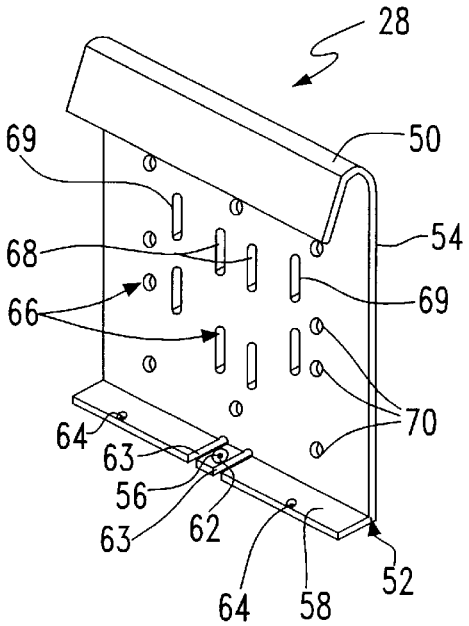
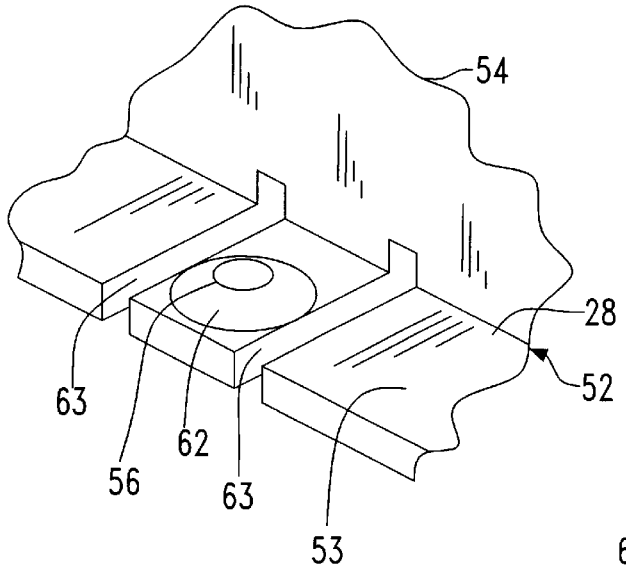
FIG. 7
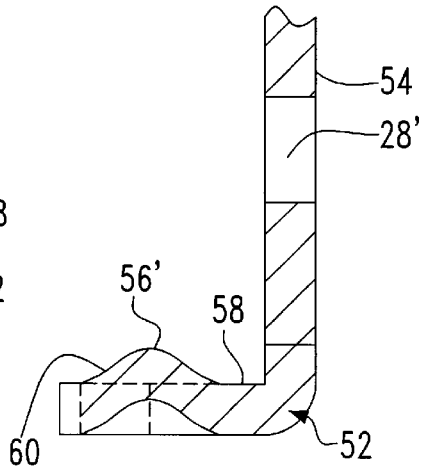
FIG. 8

WALL ORGANIZER SYSTEM

BACKGROUND OF THE INVENTION

The present invention relates to wall organizer systems of the type used in garages, utility rooms, shops, retail establishments and residential basements for organizing books, tools, chemicals, toys, sporting goods, clothes and other personal possessions, and more specifically to an organizer system based on wire mesh panels using various hooks and brackets to mount the items to the wall.

Wall organizer systems are known which employ wire mesh panels made up of a plurality of spaced, parallel vertical rods joined to a plurality of spaced, parallel horizontal rods to create a grid of mounting points. Individual hooks and brackets, including shelf brackets, are provided for being fastened to the wire rods.

However, a major drawback of conventional systems of this type is that each type of hook or bracket requires its own mounting procedure and/or hardware. Thus, the arrangement and installation of the mounting hardware to the wire mesh panel is a tedious and time consuming process. This disadvantage is exacerbated when the individual hooks or brackets need to be moved to achieve proper and/or level alignment.

Another disadvantage of conventional wall organizers of this type is that the attachment configurations of the hooks and other hardware must be secured to the wire mesh by fasteners, and have no inherent gripping power on the mesh. This disadvantage makes the conventional attachments more easily dislodged from the mesh.

Still another disadvantage of conventional wall organizer systems of this type is that the variety of available mounting hardware is relatively limited, and requires specially designed components configured for being secured to the mesh panels.

Thus, there is a need for a wall organizer system of the type using wire mesh panels which provides an easy and relatively rapid way to attach mounting hardware and brackets to the wire mesh.

Accordingly, a first object of the present invention is to provide an improved wall organizer system featuring a universal mounting plate which can accommodate a variety of conventional hooks, brackets and other such mounting hardware.

Another object of the present invention is to provide an improved wall organizer system featuring a universal mounting plate which can be attached to the mesh panel without the need for supplemental fasteners or tools.

A further object of the present invention is to provide an improved wall organizer system in which shelf and/or hook mounting brackets can be placed in a wide variety of locations on the wire mesh panels.

Yet another object of the present invention is to provide an improved wall organizer system which has the ability to mount two vertically oriented mesh panels to the wall in abutting relationship to each other.

BRIEF SUMMARY OF THE INVENTION

Accordingly, the above-listed objects are met or exceeded by the present wall organizer system for use with wire mesh panels made of a plurality of vertical and horizontal rods joined to form a screen-type pattern. The organizer system features a universal mounting plate which is secured to any mounting point on the mesh panel by a hook and snap-lock arrangement without the use of tools. Thus, the mounting plate can be easily installed anywhere on the mesh, and can also be readily moved to adjust its position as desired. In addition, the mounting plate is configured for accommodating a wide variety of conventional shelf brackets, hooks and other known organizer hardware. Another feature of the present organizer system is that it is provided with wall brackets for holding the mesh panels to the wall, which are made to securely hold either a single panel, or a pair of vertically arranged panels in abutting relationship to each other.

More specifically, the present invention provides a wall organizer system for storing items on a wall, includes at least one panel of wire mesh including a plurality of spaced, parallel, vertical rods joined to a plurality of spaced, parallel horizontal rods to define a plurality of quadrilateral mounting points, at least one wall bracket for mounting the at least one panel to the wall, at least one universal mounting plate configured for being secured in one of the mounting points and for accommodating at least one suspending member, and at least one suspending member configured for engagement on at least one of the at least one universal plate and directly to the wire mesh panel.

In a preferred embodiment, the present wall organizer system is provided in kit form including at least one wire mesh panel, a plurality of mounting brackets, a plurality of universal mounting plates and a plurality of suspending members taken from the group including shelf brackets, light duty hooks, heavy duty hooks., peg board hooks, s-hooks, tool holders and peg board trays. Certain members of the group of suspending members can be secured directly to the wire mesh, and others are configured for attachment to the universal mounting plate.

BRIEF DESCRIPTION OF THE SEVERAL VIEWS OF THE DRAWINGS

FIG. 5 is a front perspective view of the present universal mounting plate;

FIG. 6 is a rear perspective view of the plate shown in FIG. 5;

FIG. 7 is an enlarged fragmentary perspective view of the plate shown in FIG. 6;

FIG. 8 is a fragmentary vertical sectional view of an alternate locking configuration for the plate shown in FIG. 5;

DETAILED DESCRIPTION OF THE INVENTION

Figure 1:
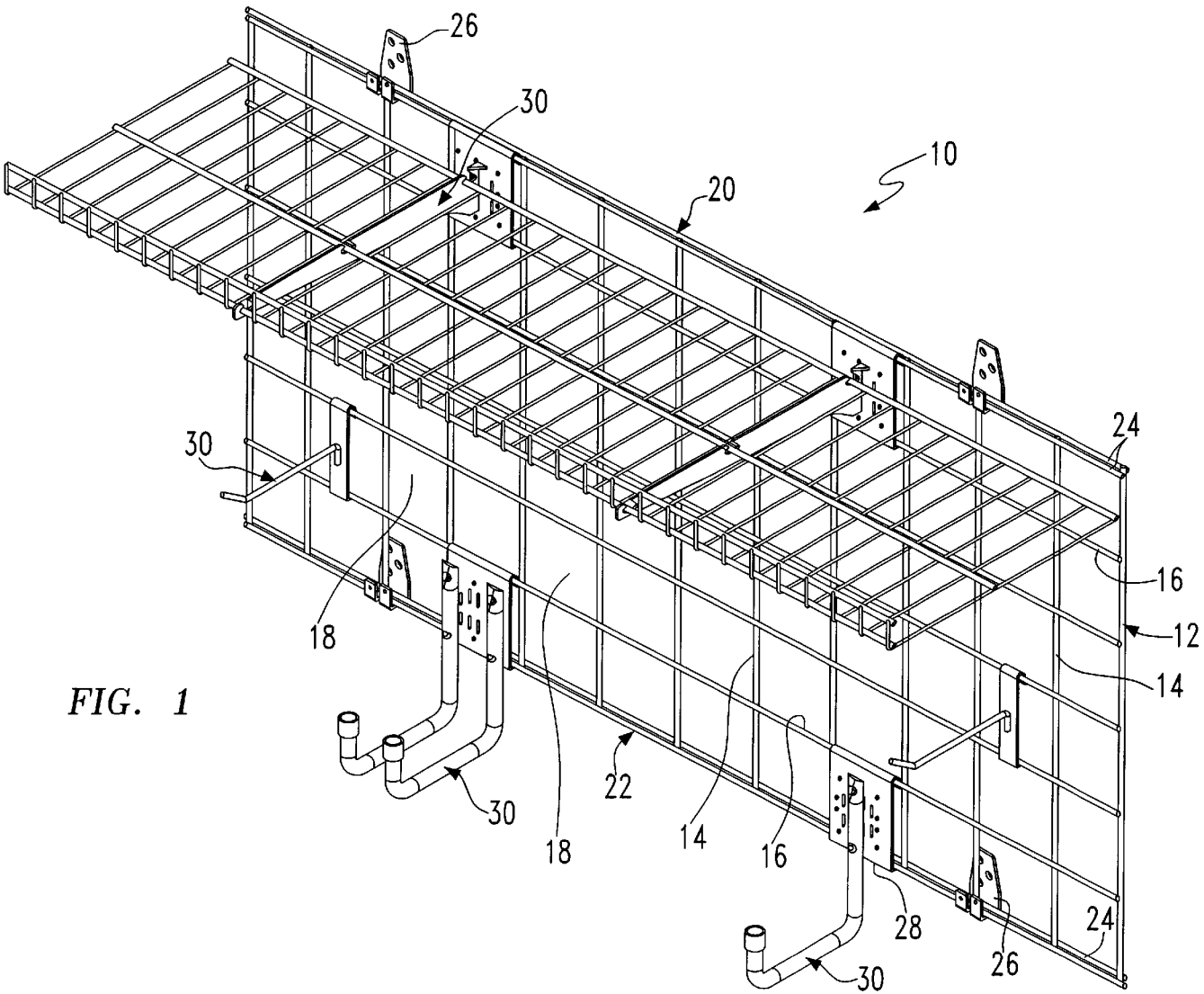
FIG. 1 is a top perspective view of the present wall organizer system shown in its orientation as mounted to a wall.
Figure 2:
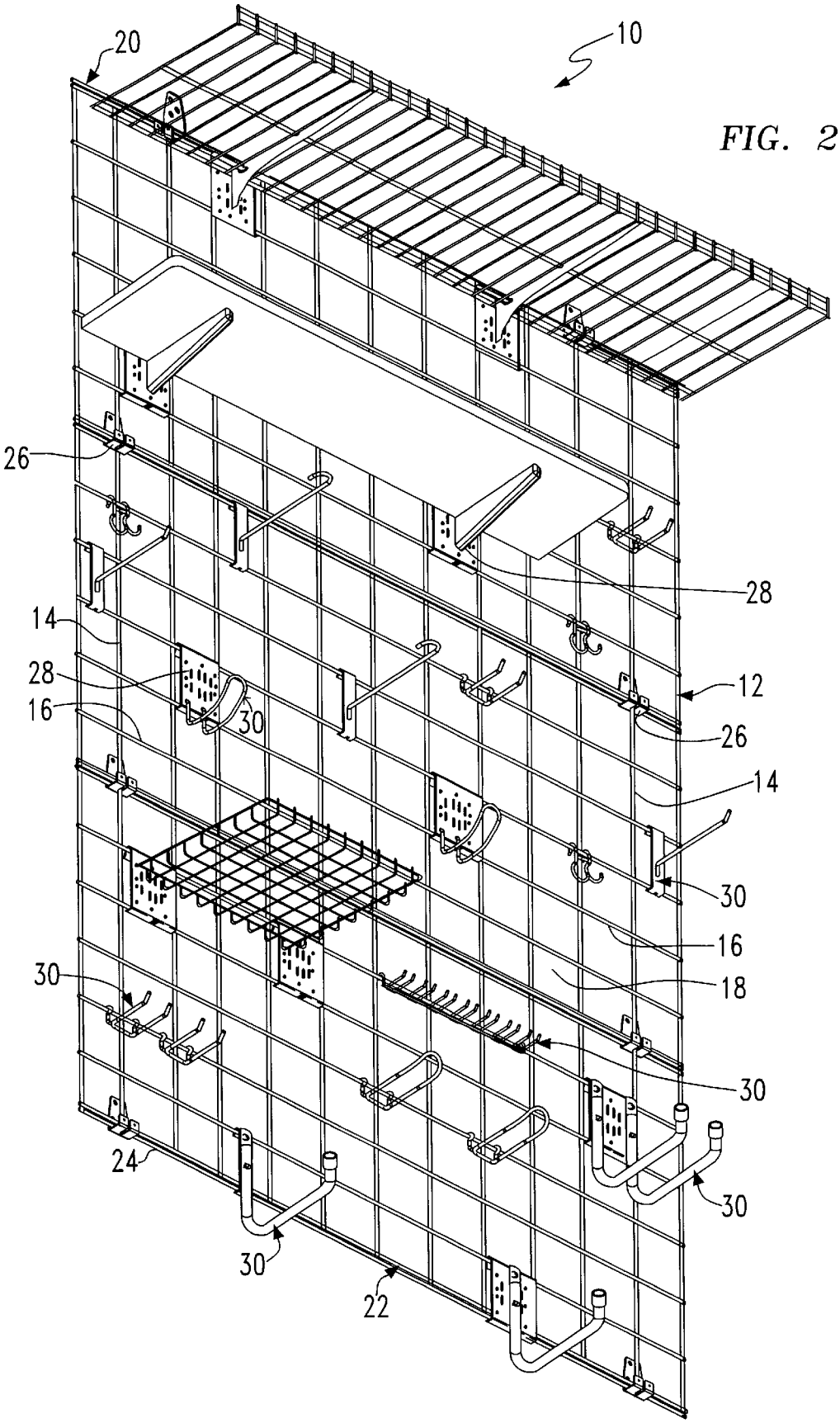
FIG. 2 is a bottom perspective view of the present wall organizer system incorporating three wire mesh panels, each shown with a variety of different suspending members in its orientation as shown mounted to a wall.

Referring now to FIGS. 1 and 2, the present wall organizer system for storing items on a wall is generally designated 10, and includes at last one panel 12 of wire mesh. In the preferred embodiment, the wire mesh is made to include a plurality of spaced, parallel, vertical rods or wires 14 joined, as by welding, adhesive or other known fastening technology to a plurality of spaced, parallel horizontal rods or wires 16 to define a plurality of quadrilateral mounting points or cells 18.

It is preferred that the rods 14, 16 are cylindrical in cross-section, however other shapes are contemplated, such as square or hex-shaped rod. It is also preferred that the rods 14, 16 be coated with protective metal, paint or plastic to minimize rust, corrosion or injury from sharp edges. While metal mesh panels 12 are preferred, it is also envisioned that injection molded plastic panels could be provided as long as the panel was capable of bearing the loads generated by stored articles such as books, tools, packaged liquid chemicals and the like.

When the rods 14, 16 are assembled to form the mesh panels 12, the resulting mounting points 18 are preferably 4 inch squares disposed in rows and columns, however other dimension and quadrilateral configurations are contemplated depending on the application. Mounting points located at the end of each row are preferably reduced in size to provide a known gap between panels when two panels are placed side-by-side. This is so that the panels can be mounted to wall studs having a standard 16 inch on center spacing. Each panel 12 is preferably provided in 1 foot×4 foot or 2 foot×4 foot sections, however other sizes are contemplated depending on the application.

Another feature of the present panel 12 is that upper and lower edges 20, 22 of the panels are provided with an extra horizontal rod 24 secured parallel to the existing horizontal rod 16 with the vertical rods 14 sandwiched therebetween to reinforce the panel by increasing rigidity, strength and supported load. Both of these rods at each edge are referred to as edge rods 24.

At least one wall bracket 26 is provided for mounting the at least one panel 12 to the wall, which can be an open stud wall, covered with wallboard, made of cinder block, concrete, or other known wall construction. Also, at least one universal mounting plate 28 is provided, and is configured for being secured in one of the mounting points 18 and for accommodating at least one suspending member, generally designated 30. The suspending members 30 are a wide variety of generally conventionally available shelf brackets, hooks, peg board hooks and trays, wire mesh trays and tool holders as are known in the art and which will be described in further detail below. As is seen in FIGS. 1 and 2, an important feature of the present wall organizer system is that the suspending members 30 can be secured to the panel 12 in a wide variety of positions, and can easily be moved without the use of tools. Some of the suspending members are mountable only on the mounting plate 28, while others are mountable directly to the panel 12.

Figure 3:
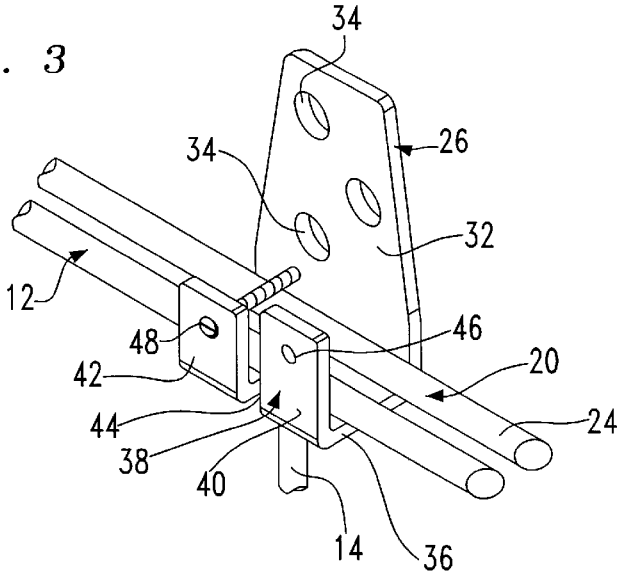
FIG. 3 is a top perspective view of the present wall mount bracket shown engaging a single mesh panel.
Figure 4:
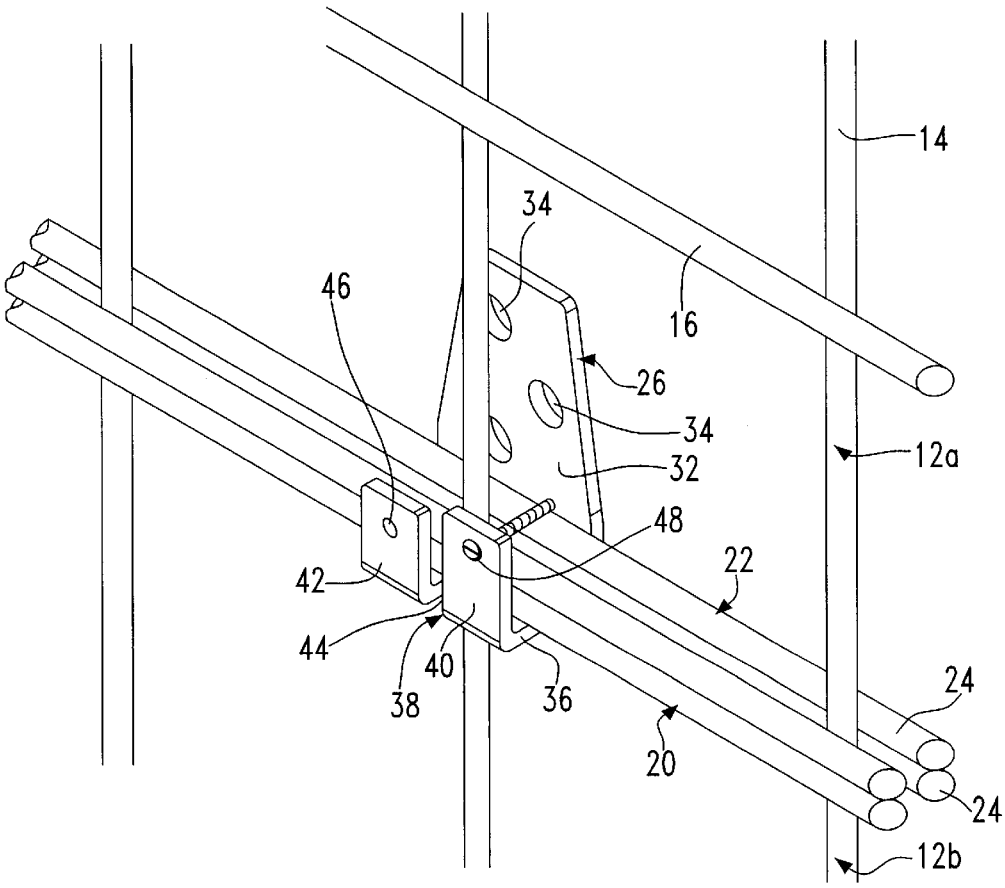
FIG. 4 is a top perspective view of the present wall mount bracket shown engaging a pair of mesh panels in abutting relationship to each other.

Referring now to FIGS. 3 and 4, the wall bracket 26 is generally U-shaped when viewed from the side, and includes a back wall 32 having mounting holes 34 (preferably countersunk) for securing the bracket to the wall, a floor 36 dimensioned for receiving the edge rods 24, and a front lip 38 for retaining the panel by securing the rods 24 within the space defined by the bracket 26. It is preferred that the wall brackets 26 be placed at about 32 inch intervals on the panels 12, because of the standard 16 inch on center spacing of wall support studs.

A feature of the present system is that the wall bracket 26 is configured to retain either a single panel 12 against the wall (best seen in FIG. 3), or a pair of panels 12*a* , 12*b* (FIG. 4), in a vertically stacked arrangement with adjacent or opposing edges 20, 22 abutting each other. This is accomplished by providing the front lip 38 with a first lip portion 40 and a second lip portion 42 separated by a slot 44 configured for accommodating one of the vertical rods 14.

It will be seen that the first lip portion 40 is taller than the second lip portion 42 for accommodating the opposing edge rods 24 of abutting, vertically stacked panels 12*a* , 12*b* . A retaining fastener aperture 46 is provided in both lip portions 40, 42 and accommodates a locking or retaining fastener 48. Whichever lip portion 40, 42 is employed to retain a corresponding single or double panel arrangement, the fastener 48 will be inserted by the installer in the appropriate retaining fastener aperture so that the fastener passes above the retained horizontal edge rods 24 to secure them in place and prevent them from becoming dislodged from the bracket 26 upon impact to the panel 12.

In the preferred embodiment, the locking fastener 48 is of the pan head screw type, the free end of which should extend into the space defined by the bracket 26 a sufficient distance so that the distance between the free end of the fastener and the back wall 32 is less than the combined thickness of the rods 14, 24. In this manner, the panel 12 is securely retained by the brackets 26. It is also contemplated that the locking fastener 48 abuts the back wall 32, and/or that the back wall may be provided with a threaded or non-threaded aperture for receiving the end of the fastener 48, and further that the locking fastener may take the form of a threaded fastener or a locking pin.

Referring now to FIGS. 5–8, the universal mounting plate 28, which is also a suspending member support, includes an upper edge 50 configured for engaging one of the horizontal rods 16, a lower edge 52 configured for engaging another one of the horizontal rods and a mounting panel 54 disposed between the upper and lower edges. In size, the plate 28 is dimensioned to fit within any one of the mounting points 18 (FIGS. 1 and 2). To this end, the upper edge 50 is bent back to form an inverted "J"-hook which is configured to engage a desired horizontal rod 16.

At the lower edge 52, the plate is bent rearward at an approximate 90° angle, and at least one biased friction fit locking formation 56 is provided on an upper surface 58 formed by the bending operation. The locking formation 56 may take the form of a raised, bent tag 60 (best seen in FIG. 8), a punctured tab 62 or other known formations which, once the upper edge 50 is hooked over the upper rod 16, will engage the lower rod 16 with a snap-type friction fit. The biasing action of the locking formation 56 is provided by the inherent springiness created by the formation 56 being separated from the adjacent portions of the upper surface 58 by slots 63, which preferably extend into the mounting panel 54. The universal mounting plate 28 will thus be secured to the panel 12 without the use of tools. However, if desired, the lower edge 52 of the plate 28 may be provided with supplemental locking apertures 64 (best seen in FIG. 6) through which threaded fasteners, ties, pins or any other type of fastener (not shown) may be inserted to further secure the plate to the panel 12.

The mounting panel 54 features a plurality of apertures 66 constructed and arranged for receiving the suspending members 30. Since the universal mounting plate 28 is intended to accommodate a wide variety of conventionally available storage hardware, the apertures 66 are intended to duplicate corresponding structures on conventional shelf standards and peg board. Accordingly, the apertures 66 include a first plurality of vertically extending apertures 68, 69 for receiving either single wall or double wall shelf brackets, and are preferably surrounded by a second plurality of generally circular apertures 70 of the type found in conventional peg-board.

Figure 13:
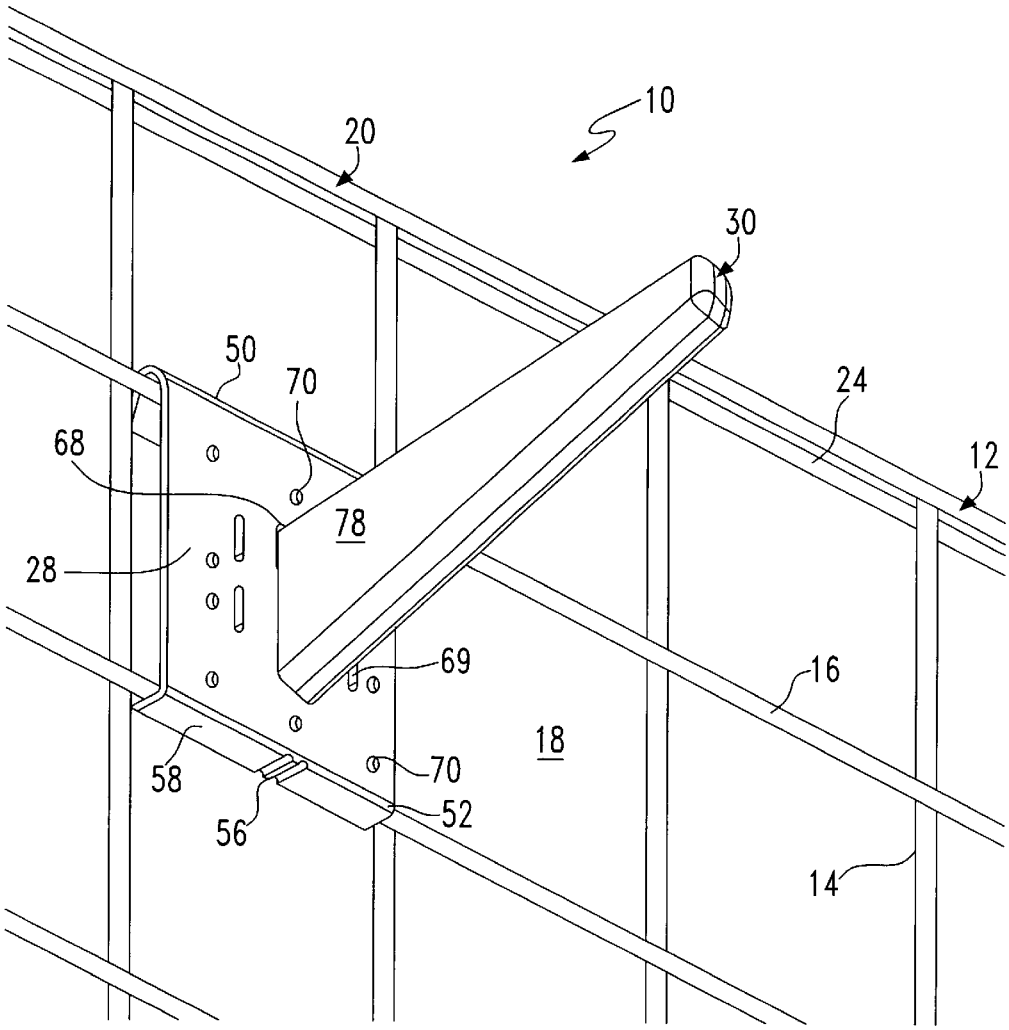
FIG. 13 is a fragmentary bottom perspective view of the present wall organizer system showing a conventional double wall shelf bracket secured to the universal mounting plate.
Figure 14:
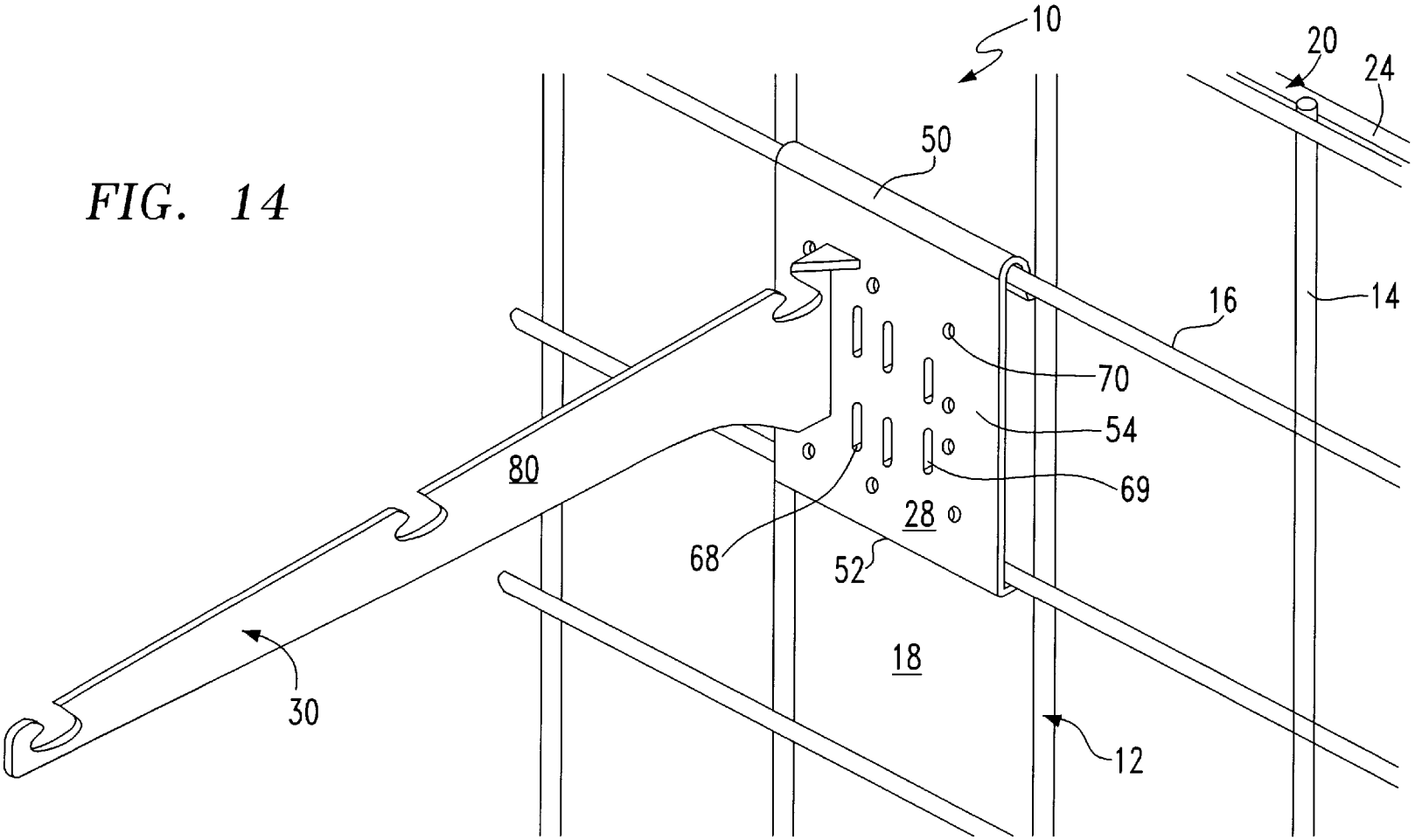
FIG. 14 is a fragmentary top perspective view of the present wall organizer system showing a conventional single wall shelf bracket secured to the universal mounting plate.

Most preferably, the apertures 68 are constructed and arranged to be generally parallel to receive double wall shelf brackets (FIG. 13) and apertures 69 are constructed and arranged to receive single wall shelf brackets (FIG. 14). The apertures 70 are disposed to have a 1 inch spacing between each other, but other spacings are contemplated depending on the application. Thus, in the preferred embodiment, since standard double wall shelf brackets require four standard apertures 68 each, and standard single wall shelf brackets require two standard apertures 69 each disposed in a different standard spacing from the apertures 68, the mounting plate 28 can accommodate one double wall bracket in the apertures 68, at least one single wall bracket in the apertures 69 and a plurality of peg-board type hooks or other hardware in the apertures 70. It will be appreciated that the number and arrangement of apertures 68, 69 and 70 may vary to suit the application.

It is also contemplated that the plate 28 may be provided in a form for use in supporting suspending members 30 without being attached to the mesh panel 12. In such an embodiment, the mounting panel 54 would include the apertures, 68, 69 and/or 70, and the upper and lower edges 50, 52 would be altered to suit the particular attachment application provided that a space is created behind the panel to accommodate shelf bracket tabs or peg board hook tips.

Figure 10:
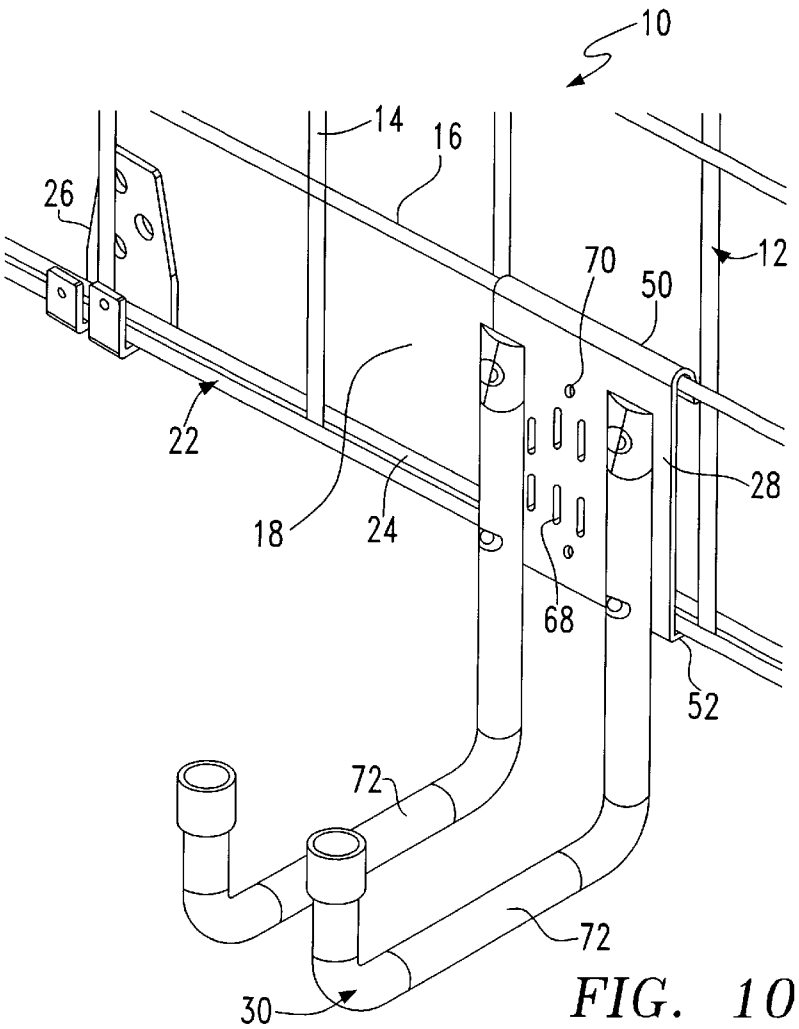
FIG. 10 is a fragmentary front perspective view of the present wall organizer system showing a pair of heavy duty hooks secured to the universal mounting plate.
Figure 9:
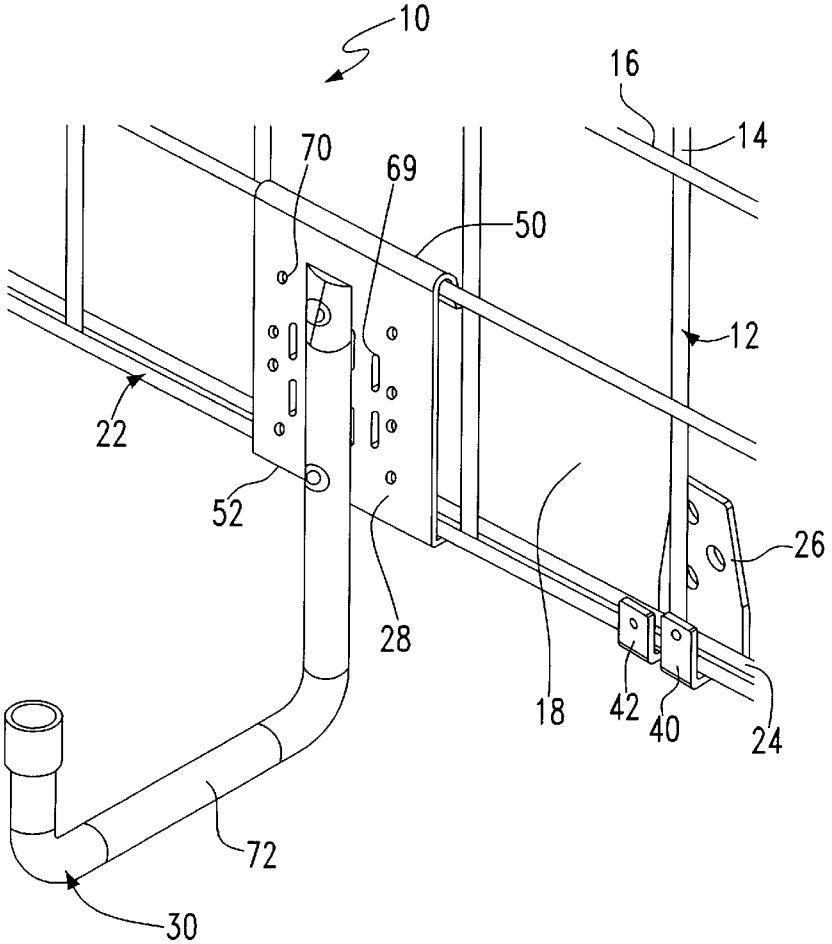
FIG. 9 is a fragmentary front perspective view of the present wall organizer system showing a single heavy duty hook secured to the universal mounting plate.

Referring now to FIGS. 9 and 10, the present panel 12 is shown wherein the universal mounting plate 28 is provided with heavy duty hooks 72 secured thereto. In FIG. 9, a single hook 72 is mounted to the apertures 70 with fasteners (not shown) such as conventional screws and nuts, rivets or the equivalent. In FIG. 10, a pair of hooks 72 are mounted to the same plate 28 in side-by-side fashion.

Figure 11:
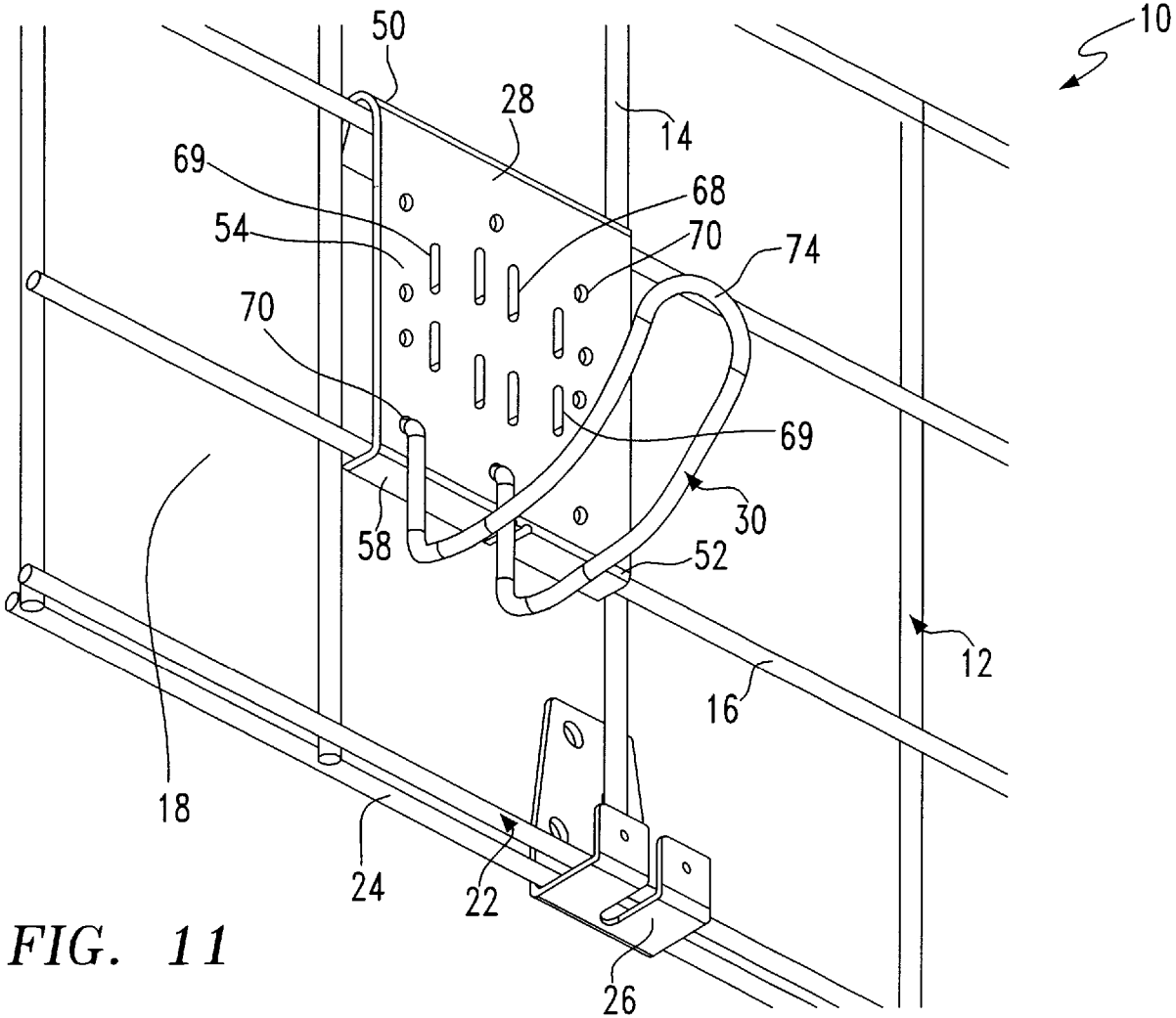
FIG. 11 is a fragmentary bottom perspective view of the present wall organizer system showing a conventional peg board hook secured to -the universal mounting plate.
Figure 12:
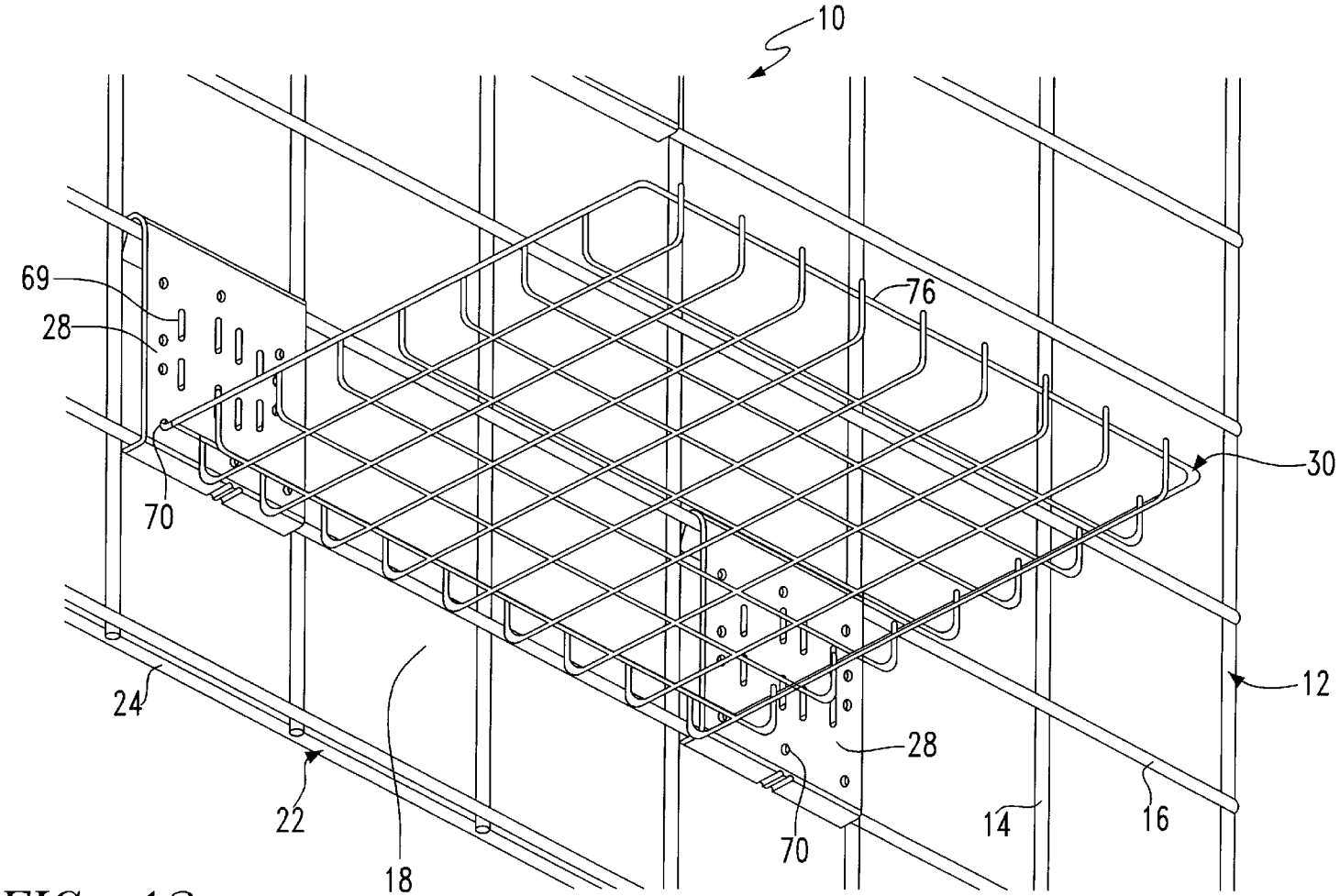
FIG. 12 is a fragmentary bottom perspective view of the present wall organizer system showing a conventional peg board tray secured to the universal mounting plate.

Referring now to FIGS. 11 and 12, in FIG. 11, a light duty peg board-type hook 74 is shown engaged in apertures 70. FIG. 12 depicts a wire mesh-type tray 76 suspended from a pair of adjacent universal mounting plates 28 so that the tray is engaged in selected apertures 70. A rear end of the tray is supported by the panel 54 of the plate 28 so that the tray is maintained perpendicular to the wall.

Referring now to FIGS. 13 and 14, the universal mounting plate 28 can also accommodate conventional shelf brackets. In FIG. 13, it is seen that the arrangement of the vertically extending apertures 68 is such that a conventional dual walled, double track bracket 78 is accommodatable in the same manner as in a conventional shelf bracket standard, with the tabs of the bracket (not shown) engaging the apertures 68. In FIG. 14, it is also seen that a conventional single wall shelf bracket 80 may also be accommodated in the apertures 69.

Figure 16:
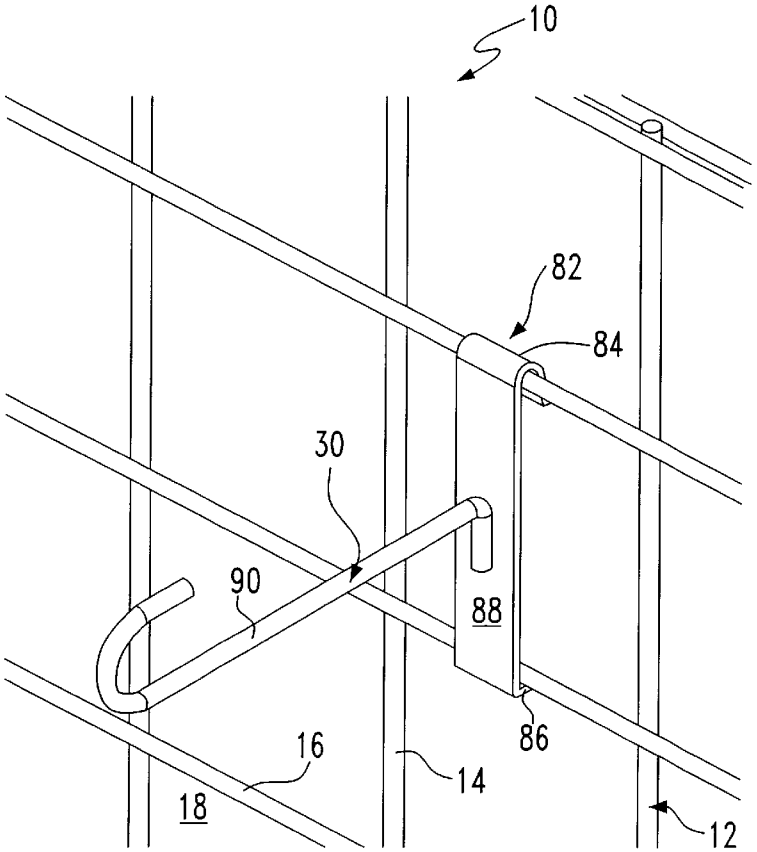
FIG. 16 is a fragmentary top perspective view of the present wall organizer system showing the hook of FIG. 15 secured to the mesh panel.
Figure 15:
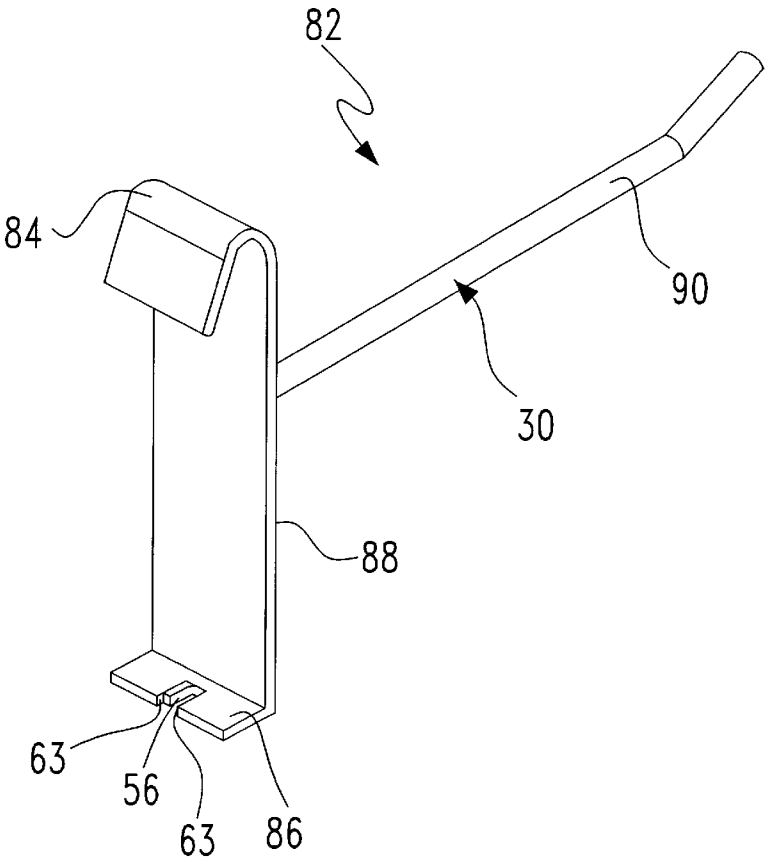
FIG. 15 is a rear perspective view of an individual hook configured for use with the present system.

Referring now to FIGS. 15 and 16, the system 10 may also include individual light duty hooks or other type of suspending or hanging hardware which do not need to be attached to the universal mounting plate 28, but instead are mountable directly to the wire mesh panel 12. A clamp-on hook 82 of this type attaches to the panel 12 in the same manner 10 as the universal mounting plate 28. An upper edge 84 is formed into an inverted "J"-hook for engaging a horizontal rod 16, and a lower edge 86 is bent back at an approximate 90° angle and is provided with at least one biased friction-type snap fit formation 56 bordered by a pair of slots 63 (as seen in FIG. 7). Between the upper and lower edges 84, 86, a hook panel or mounting panel 88 receives a hook 90 fastened thereto by welding or other known attachment technology. The upper edge 84, the lower edge 86 and the panel 88 thus define a suspending member support. The hook 90 may be either fixed or laterally pivotable relative to the hook panel 88.

Figure 17:
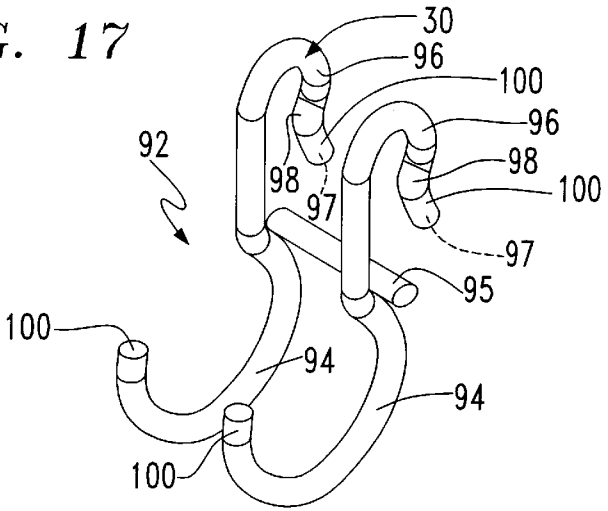
FIG. 17 is a top perspective view of a double S-hook suitable for use with the present wall organizer system.

Referring now to FIG. 17, a light duty S-hook 92 of the double-hook type is provided and includes first and second hook members 94 retained in spaced apart relationship with each other by a spacer bar 95. The hook 92 is designed to engage the panel 12 by the hook members 94 being hooked at their upper ends 96 upon a horizontal rod 16, with the adjacent vertical rod 14 being engaged by the spacer bar 95 to prevent the hook 92 from rotating backward toward the wall upon loading. An important feature of the hook 92 is that it is snap-fit to the panel 12 through the construction of the upper end 96. The radius of the upper end 96 is such that an opening is defined which is smaller than the diameter of the rods 16.

Also, a tip portion 97 of the upper end 96 is angled rearwardly to assist installation and to further constrict the opening defined by the upper end 96. An angled elbow 98 of the upper end 96 further constricts the opening and adds to the snap fit structure. Any of the hooks of the present system 10 may be provided with protective endcaps 100 for preventing injury and protecting the suspended items from sharp edges.

Figure 18:
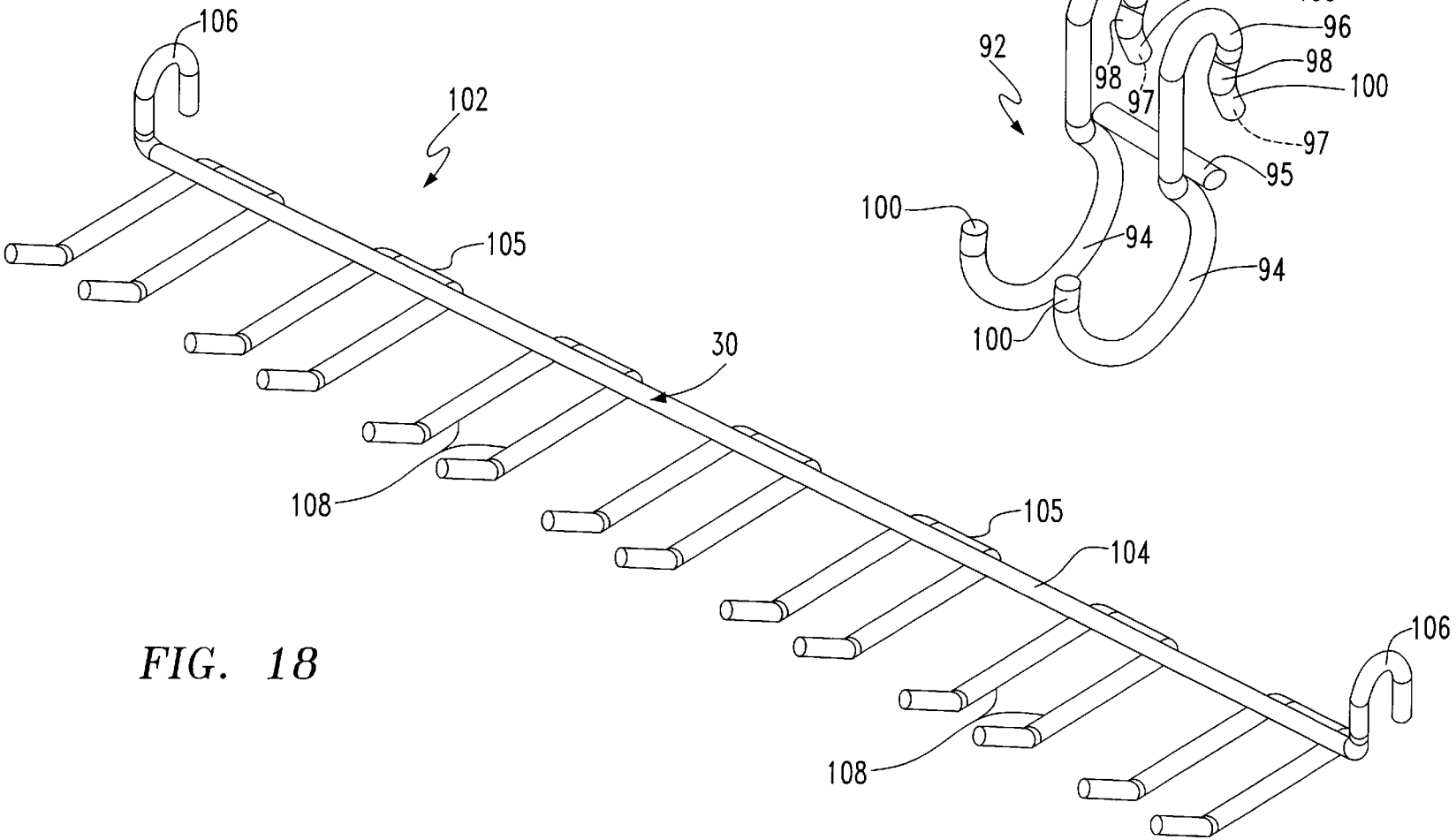
FIG. 18 is a top perspective view of a tool rack suitable for use with the present wall organizer system.

Referring now to FIG. 18, a tool rack 102 suitable for use with the present system 10 includes a main spacer bar 104 with hooks 106 at each end for engaging a selected horizontal rod 16. It is preferred that the hooks 106 have the same snap-fit feature as the upper ends 96 of the hooks 92. A plurality of generally "U"-shaped hook pairs 108 are secured to the spacer bar 104 in spaced relationship to each other, and are configured for retaining tools such as hammers, shovels, axes, rakes, as well as shoes, clothing, neckties, etc. A rear bar 105 of the hook pairs 108 performs the same function as the spacer bar 95. The hook pairs 108 are each secured to the spacer bar 104 by welding or other known fastening technology. If desired, tips of the hook pairs 108 may be angled upward to better retain suspended articles as is known in the art.

Figure 19:
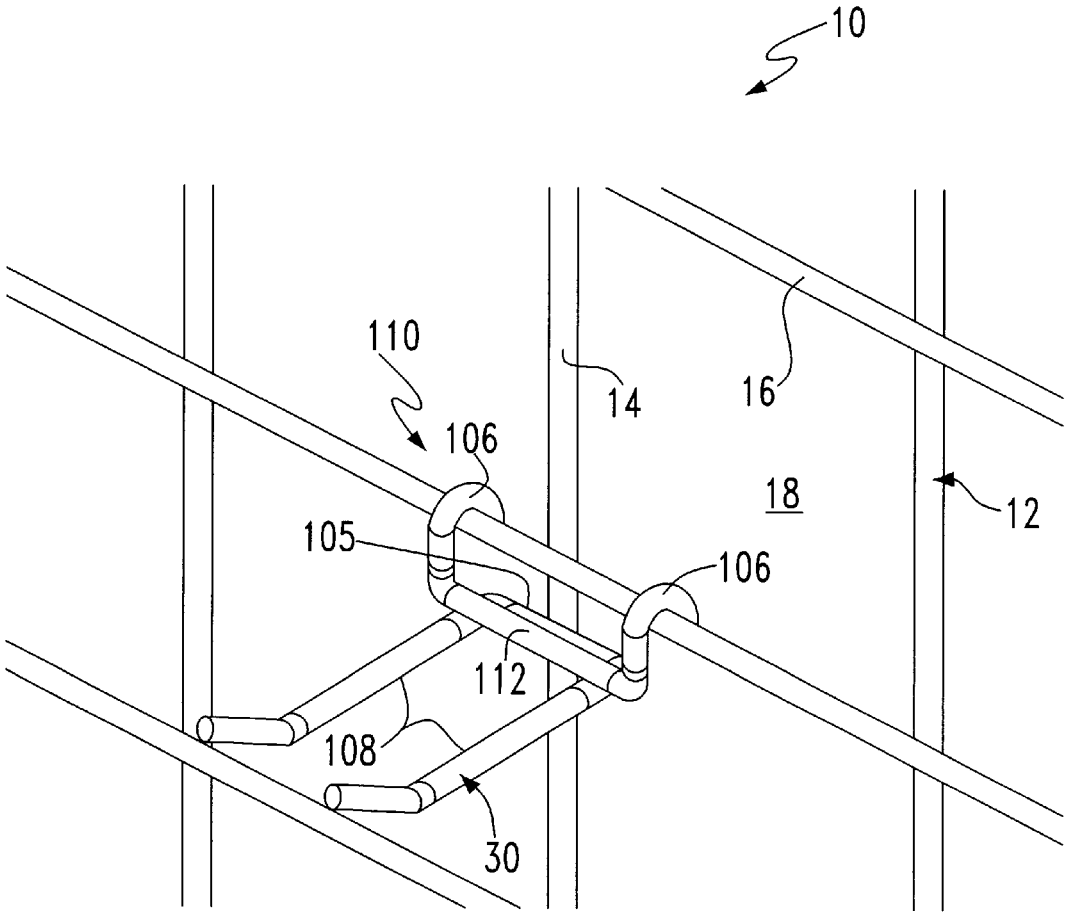
FIG. 19 is a top perspective view of an alternative tool rack suitable for use with the present wall organizer system.

Referring now to FIG. 19, an individual double hook 110 may also be provided for use with the system 10, and is similar to the tool rack 102, only being shorter and consisting of a single hook pair 108. Similar components are designated with similar reference numbers.

In operation, the present wall organizer system 10 is preferably provided in kit form with at least one panel 12 defining a plurality of mounting points 18, a plurality of wall brackets 26 for mounting the panel 12 to the wall, a plurality of universal mounting plates 28, each configured for being secured in one of the mounting points 18 and for accommodating at least one suspending member 30, and a plurality of suspending members configured for engagement on at least one of the universal plate 28 and directly to the panel 12 These suspending members include, but are not limited to, the heavy duty hooks 72, light duty hooks 74, 82, wire mesh trays 76, shelf brackets 78, 80, S-hooks 92, tool racks 102, and individual double hooks 110. It is contemplated that some of these suspending members 30 may be included in a given kit, with the purchaser being given the opportunity to supplement the kit with other suspending members of like or dissimilar configurations, being sold separately. The suspending members 30 may be easily installed and moved as desired upon the panel 12, and are securably held thereon. The universal mounting plate 28 features the ability to place a variety of suspending members upon the panel without having to use different types of mounting hardware.

While a particular embodiment of the wall organizer system of the invention has been shown and described, it will be appreciated by those skilled in the art that changes and modifications may be made thereto without departing from the invention in its broader aspects and as set forth in the following claims.

What is claimed is:

1. A wall organizer system for storing items on a wall, comprising:

at least one panel of wire mesh including a plurality of spaced, parallel, vertical rods joined to a plurality of spaced, parallel, horizontal rods to define a plurality of quadrilateral mounting points, said panel having an upper edge and a lower edge, at least one of said upper edge and lower edge including a pair of horizontal edge rods spaced apart by and joined to said plurality of vertical rods;

at least one wall bracket for mounting said at least one panel to the wall, said at least one wall bracket including a back wall having mounting holes for securing said at least one wall bracket to the wall, a floor for receiving and supporting said pair of horizontal edge rods, and a front lip for retaining said panel;

first and second suspending members, said first suspending member being distinct from said second suspending member; and a plurality of universal mounting plates, each plate being configured for being secured in any of said mounting points and for accommodating at least a portion of either of said first and second suspending members, wherein each plate comprises a mounting panel, a first plurality of apertures on said mounting panel for receiving said first suspending member, and a second plurality of apertures on said mounting panel distinct from said first plurality of apertures for receiving said second suspending member;

wherein at least one of said first and second suspending members is configured for detachable engagement on at least one of said plurality of universal mounting plates and directly on said at least one wire mesh panel;

wherein said front lip includes a first lip portion and a second lip portion separated by a slot configured for accommodating one of said vertical rods; and wherein said first lip portion is taller than said second lip portion for accommodating opposing edge rods of abutting, vertically stacked panels.

2. The system as defined in claim 1 wherein each of said first and second lip portions is provided with at least one fastener aperture for receiving a locking fastener for retaining said rods in said bracket.

3. A wall organizer system for storing items on a wall, comprising:

at least one panel of wire mesh including a plurality of spaced, parallel, vertical rods joined to a plurality of spaced, parallel, horizontal rods to define a plurality of quadrilateral mounting points, said panel having an upper edge and a lower edge, at least one of said upper edge and lower edge including a pair of horizontal edge rods spaced apart by and joined to said plurality of vertical rods;

at least one wall bracket for mounting said at least one panel to the wall, said at least one wall bracket including a back wall having mounting holes for securing said at least one wall bracket to the wall, a floor for receiving and supporting said pair of horizontal edge rods, and a front lip for retaining said panel;

first and second suspending members, said first suspending member being distinct from said second suspending member; and a plurality of universal mounting plates, each plate being configured for being secured in any of said mounting points and for accommodating at least a portion of either of said first and second suspending members, wherein each plate comprises a mounting panel, a first plurality of apertures on said mounting panel for receiving said first suspending member, and a second plurality of apertures on said mounting panel distinct from said first plurality of apertures for receiving said second suspending member;

wherein at least one of said first and second suspending members is configured for detachable engagement on at least one of said plurality of universal mounting plates and directly on said at least one wire mesh panel;

wherein said front lip includes a first lip portion and a second lip portion separated by a slot configured for accommodating one of said vertical rods; and wherein at least one of said first and second lip portions is provided with a fastener aperture for receiving a locking fastener for retaining said rods in said bracket.

4. The system as defined in claim 3 wherein said mounting points are square-shaped.

5. The system as defined in claim 3 wherein said wall bracket is generally U-shaped when viewed from the side.

6. A wall organizer system for storing items on a wall, comprising:

at least one panel of wire mesh including a plurality of spaced, parallel, vertical rods joined to a plurality of spaced, parallel, horizontal rods to define a plurality of quadrilateral mounting points, said panel having an upper edge and a lower edge, at least one of said upper edge and lower edge including a pair of horizontal edge rods spaced apart by and joined to said plurality of vertical rods;

at least one wall bracket for mounting said at least one panel to the wall, said at least one wall bracket including a back wall having mounting holes for securing said at least one wall bracket to the wall, a floor for receiving and supporting said pair of horizontal edge rods, and a front lip for retaining said panel;

first and second suspending members, said first suspending member being distinct from said second suspending member; and a plurality of universal mounting plates, each plate being configured for being secured in any of said mounting points and for accommodating at least a portion of either of said first and second suspending members, wherein each plate comprises a mounting panel, a first plurality of apertures on said mounting panel for receiving said first suspending member, and a second plurality of apertures on said mounting panel distinct from said first plurality of apertures for receiving said second suspending member;

wherein at least one of said first and second suspending members is configured for detachable engagement on at least one of said plurality of universal mounting plates and directly on said at least one wire mesh panel;

wherein at least one of said first and second suspending members is at least one of, light duty hooks and S-hooks; and wherein said light duty hooks and S-hooks include a pair of hook members retained in spaced apart relationship with each other by a spacer bar, wherein each said hook member has an upper end configured with an opening having a diameter less than that of said horizontal rod to engage one of said horizontal rods of said panel in a snap-fit arrangement.

7. The system as defined in claim 6, further including individual hooks which are directly securable to said horizontal rods.

8. For a wall organizer system for storing items on a wall, the system including at least one panel of wire mesh made of a plurality of spaced, parallel, vertical rods joined to a plurality of spaced, parallel, horizontal rods to define a plurality of quadrilateral mounting points, at least one wall bracket for mounting the at least one panel to the wall and at least one suspending member, a suspending member support configured for being secured in one of the mounting points and for accommodating the at least one suspending member, comprising;

an upper edge configured for engaging one of the horizontal rods, a lower edge configured for frictionally engaging another one of the horizontal rods with a snap-fit, and a mounting panel disposed between said upper and lower edges, said mounting panel being configured for receiving a portion of said at least one suspending member, wherein said upper edge forms a hook for engaging the horizontal rod, and said lower edge has at least one locking formation for engaging the rod with a snap fit, and wherein said at least one locking formation has a spring-like tag for locking said support to the rod.

9. The suspending member support as defined in claim 8 wherein said mounting panel is configured to be securable to said suspending member by welding.

10. The suspending member support as defined in claim 8 further including a plurality of apertures constructed and arranged for receiving the suspending members.

11. The suspending member support as defined in claim 10 wherein said plurality of apertures on said mounting panel include a first plurality of vertically extending apertures for receiving shelf brackets, and being surrounded by a second plurality of generally circular apertures.

12. The suspending member support as defined in claim 8 wherein said tag has a pair of edges and wherein said lower edge has a slot formed on both of said edges to separate said tag from said lower edge on two sides.

13. The suspending member support as defined in claim 8 wherein said support is dimensioned for disposition at any one of said mounting points on said panel.

14. A universal mounting plate, comprising:

a mounting panel;

a first plurality of generally parallel, vertically extending apertures on said mounting panel arranged for receiving a portion of at least one of a single wall shelf bracket and a double wall shelf bracket;

a second plurality of generally circular apertures on said mounting panel being configured for receiving a generally circular cross-sectioned portion of a suspending member; and a third plurality of generally parallel, vertically extending apertures on said mounting panel being arranged differently than said first plurality of apertures for receiving a portion of at least one of a single wall shelf bracket and a double wall shelf bracket.

15. The system as defined in claim 14 wherein said universal mounting plate further includes an upper edge configured for engaging a first horizontal rod, and a lower edge configured for engaging a second horizontal rod.

16. The universal mounting plate as defined in claim 14 wherein said first and second pluralities of apertures are surrounded by said third plurality of apertures.

17. A wall organizer system for storing items on a wall, comprising:

at least one panel of wire mesh including a plurality of spaced, parallel, vertical rods joined to a plurality of spaced, parallel, horizontal rods to define a plurality of quadrilateral mounting points;

at least one wall bracket for mounting said at least one panel to the wall;

first and second suspending members;

at least one universal mounting plate configured for being secured in one of said mounting points and configured to accommodate either of said first and second suspending members;

each of said first and second suspending members being configured for engagement on at least one of said at least one universal mounting plate and directly on said at least one panel;

said first suspending member being at least one of light duty hooks and S-hooks;

said light duty hooks and S-hooks including a pair of hook members retained in spaced apart relationship with each other by a spacer bar; and each said hook member having an upper end configured with an opening having a diameter less than that of said horizontal rod to engage one of said horizontal rods of said panel in a snap-fit arrangement.

18. A wall organizer system for storing items on a wall, comprising:

at least one panel of wire mesh including a plurality of spaced, parallel, vertical rods joined to a plurality of spaced, parallel, horizontal rods to define a plurality of quadrilateral mounting points, wherein said panel has an upper edge and a lower edge, and wherein at least one of said upper and lower edges is defines by first and second horizontal edge rods spaced apart by, and joined to said vertical rods;

at least one wall bracket for mounting said at least one panel to the wall, said wall bracket being generally U-shaped when viewed from the side, each of said at least one wall bracket including a back wall having mounting holes for securing the bracket to the wall, a floor for receiving said first and second horizontal edge rods, and a front lip for retaining said first and second horizontal edge rods;

first and second suspending members, said first suspending member being distinct from said second suspending member;

a plurality of universal mounting plates, each plate being configured for being secured in any of said mounting points and for accommodating at least a portion of either of said first and second suspending members, wherein each plate comprises a mounting panel, a first plurality of generally parallel, vertically extending apertures on said mounting panel arranged for receiving a portion of at least one of a single wall shelf bracket and a double wall shelf bracket, a second plurality of generally circular apertures on said mounting panel being configured for receiving a generally circular cross-sectioned portion of a suspending member, and a third plurality of generally parallel, vertically extending apertures on said mounting panel being arranged differently than said fist plurality of apertures for receiving a potion of at least one of a single wall shelf bracket and a double wall shelf bracket; and wherein said vertical rods and said first and second horizontal edge rods define a space from the wall for accommodating at least a portion of at least one of said plurality of universal mounting plates and at least a portion of one of said first and second suspending members.

* * * * *

UNITED STATES PATENT AND TRADEMARK OFFICE

CERTIFICATE OF CORRECTION

PATENT NO. : 6,299,001 B1
DATED : October 9, 2001
INVENTOR(S) : Frolov et al.

It is certified that error appears in the above-identified patent and that said Letters Patent is hereby corrected as shown below:

Column 9,
Line 26, before "light duty hooks" please delete the comma [,]

Column 11,
Line 1, delete "defines" and insert -- defined -- thereto

Signed and Sealed this

Ninth Day of April, 2002

*Attest:*

JAMES E. ROGAN
*Director of the United States Patent and Trademark Office*

*Attesting Officer*